United States Patent [19]

Wallis

[11] 4,262,568

[45] Apr. 21, 1981

[54] CUT-OFF MECHANISM FOR CORRUGATED STRIP

[76] Inventor: Bernard J. Wallis, 25200 Trowbridge Ave., Dearborn, Mich. 48124

[21] Appl. No.: 92,478

[22] Filed: Nov. 8, 1979

[51] Int. Cl.[3] ..... B26D 5/42

[52] U.S. Cl. ..... 83/176; 83/169; 83/262; 83/282; 83/374; 83/926 R

[58] Field of Search ..... 83/169, 175, 176, 262, 83/282, 451, 925 R, 374

[56] References Cited

U.S. PATENT DOCUMENTS

| | | | |
|---|---|---|---|
| 2,833,351 | 5/1958 | Paton et al. | 83/176 |
| 3,838,617 | 10/1974 | Felker | 83/176 X |
| 3,866,642 | 2/1975 | Walser | 83/169 X |

*Primary Examiner*—J. M. Meister

*Attorney, Agent, or Firm*—Barnes, Kisselle, Raisch & Choate

[57] ABSTRACT

A corrugated thin metal strip is advanced through a cut-off mechanism having a movable upper blade and a lower stationary blade. A curtain of air is directed downwardly against the tip of the corrugated strip to momentarily arrest its movement with a return bend between a pair of adjacent convolutions of the strip centered over the stationary blade. The upper blade descends and shears the strip transversely along a return bend.

12 Claims, 7 Drawing Figures

CUT-OFF MECHANISM FOR CORRUGATED STRIP

This invention relates to a cut-off mechanism and, more particularly, to a device for shearing thin corrugated metal strips to predetermined lengths.

In the manufacture of heat exchangers, a thin metal strip is normally corrugated in a continuous operation and simultaneously cut into sections of predetermined length. The shear used for cutting such sections to length is normally of the guillotine type having a stationary blade and a movable blade. The specifications for such corrugated heat exchanger sections normally require a predetermined minimum number of corrugations per unit length. Frequently the corrugations are formed in metal strips having a thickness in the range of 0.001 to 0.005 inches and, as a consequence, such strips are very flimsy and difficult to locate in a precise position for shearing into predetermined lengths. Since it is difficult to mechanically count the successive convolutions of the corrugated strips as they approach the cut-off shear, manufacturers of such strips frequently cut them to a length at least slightly longer than required to insure meeting the corrugations per unit length specified by the manufacturer of the heat exchanger. In addition, because of its flimsiness and the inability to precisely locate the strip relative to the cut-off mechanism, the strip is sheared at random locations around the extent of a corrugation rather than at the crest or root of a corrugation where the shearing is most desirable to avoid unsightly crimps and bends at the end of a sheared corrugated section.

The primary object of this invention is to provide a cut-off mechanism for such corrugated strips which enables the strip to be cut into accurately predetermined lengths and which, at the same time, insures shearing of the strip at the root or the crest of a corrugation, that is, at the return bend between successive convolutions of the strip.

Another object of the invention is to locate a corrugated strip precisely relative to a shear blade by means of a stream of air.

More specifically, in accordance with this invention means are provided for directing a curtain of air at precisely timed intervals in a direction generally perpendicular to the plane of the corrugated strip at a location directly adjacent the cut-off blade. The air curtain serves to displace the corrugation against which it is directed so that the air flows into the space between a pair of adjacent convolutions in alignment with the cutting edge of the cut-off blade.

Other objects, features and advantages of the present invention will become apparent from the following description and accompanying drawings, in which.

Figure 1:
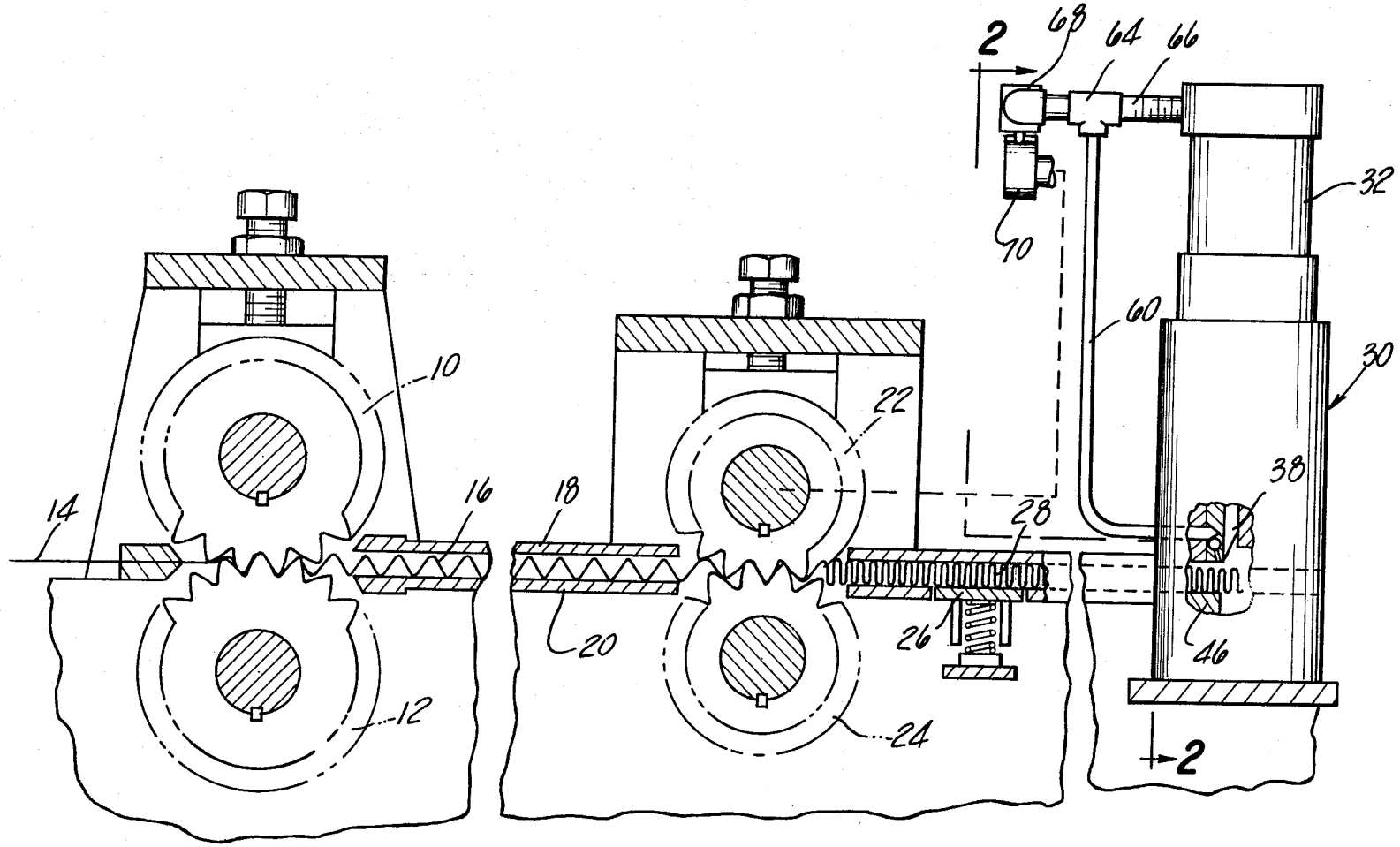
FIG. 1 is a side elevational view, with parts in section, of a machine for corrugating metal strips and including the cut-off mechanism of the present invention.

Referring first to FIG. 1, there is illustrated a portion of a generally conventional corrugated fin rolling machine which includes a pair of form rolls 10 and 12 mounted on the frame of the machine in intermeshing relation as illustrated. Sheet metal ribbon stock 14 is fed from a pair of feed rollers (not illustrated) between form rolls 10 and 12 so as to form corrugations therein, the strip emmerging from the form rolls being illustrated at 16. As the corrugated strip 16 emerges from the form rolls 10, 12 it is guided by rails 18, 20 to a pair of gathering rolls 22, 24 which advances the corrugated strip toward a spring pressure plate 26. Pressure plate 26 cooperates with rail 18 to frictionally retard the advancing movement of the corrugated strip so that it is gathered or compressed lengthwise by further bending at the crests of the convolutions into finished form as shown at 28. The fin rolling mechanism thus far described is substantially conventional and forms no part of the present invention.

The present invention has to do with a cut-off mechanism generally designated 30 which is located downstream beyond pressure plate 26. In the embodiment illustrated the cut-off mechanism 30 comprises a very rigid rectangular frame 31 on which an air cylinder 32 is supported. A piston rod 34 connected with a piston (not shown) in cylinder 32 extends downwardly and has a bracket 36 at its lower end to which a cut-off blade 38 is rigidly connected. Cut-off blade 38 is guided for vertical reciprocation within a guide block 40 fixedly mounted in frame 31. The cutting edge 42 of blade 38 is located at the lower end of a flat vertically extending face 44 on blade 38. The opposite face of blade 38 is tapered as at 45. Blade 38 is adapted to cooperate with a lower blade 46 having a cutting edge 48 at the upper end thereof. The lower blade 46 is fixedly mounted on a block 50 in frame 31. The top face of block 50 forms a horizontal extension of the lower guide rail 20 for guiding the corrugated strip through the cut-off mechanism.

Plate **40*a* of guide block 40 for the upper blade 38 is formed with a transversely extending manifold passageway 52. A plurality of vertically extending passageways 54 extend downwardly from passageway 52 and are spaced transversely across plate 40*a*. Passageways 54 are disposed directly adjacent the flat face 44 of blade 38 and terminate in downwardly directed orifices 56. A coupling 58 on plate 40*b* of guide block 40 connects manifold passageway 52 through a passageway 53 with a conduit 60 which extends upwardly to a tee fitting 64. Fitting 64 is connected to the upper end of cylinder 32 by a short conduit 66. The other side of tee fitting 64 is connected to the outlet of an air valve 68, the inlet of which is connected to a source of air under pressure. Air valve 68 is operated intermittently by a cam 70 which is rotated in timed relation with the gathering rolls 22,24. Whenever valve 68 is opened by cam 70, air under pressure is directed to the upper end of cylinder 32 to shift blade 38** downwardly from the broken line to the position shown in full lines. A spring, or other suitable means, may be employed for quickly returning the blade to its retracted upper position shown in broken lines in FIG. 5.

Figure 5:
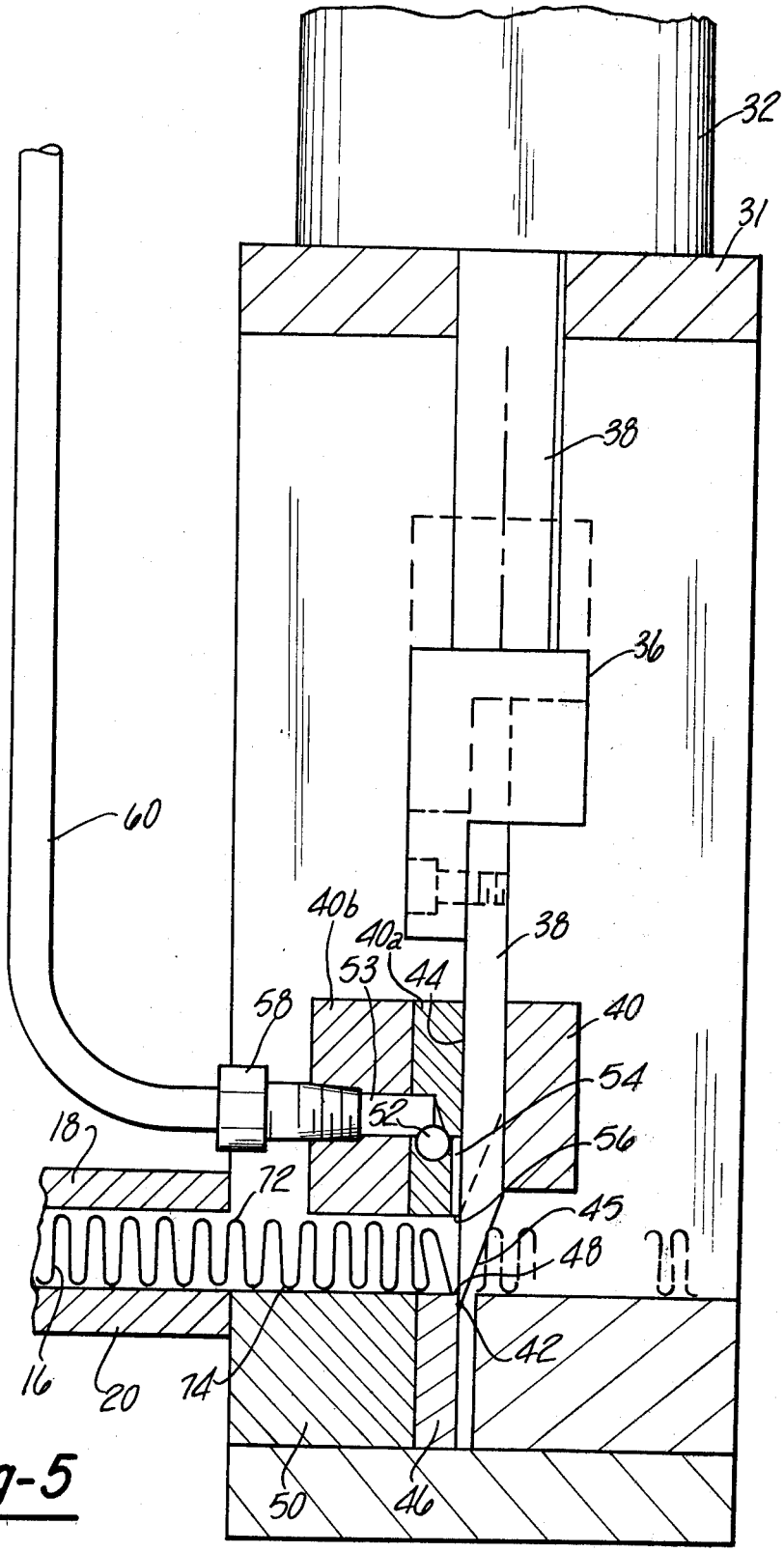
FIG. 5 is a sectional view along the line 5—5 in FIG. 2.
Figure 2:
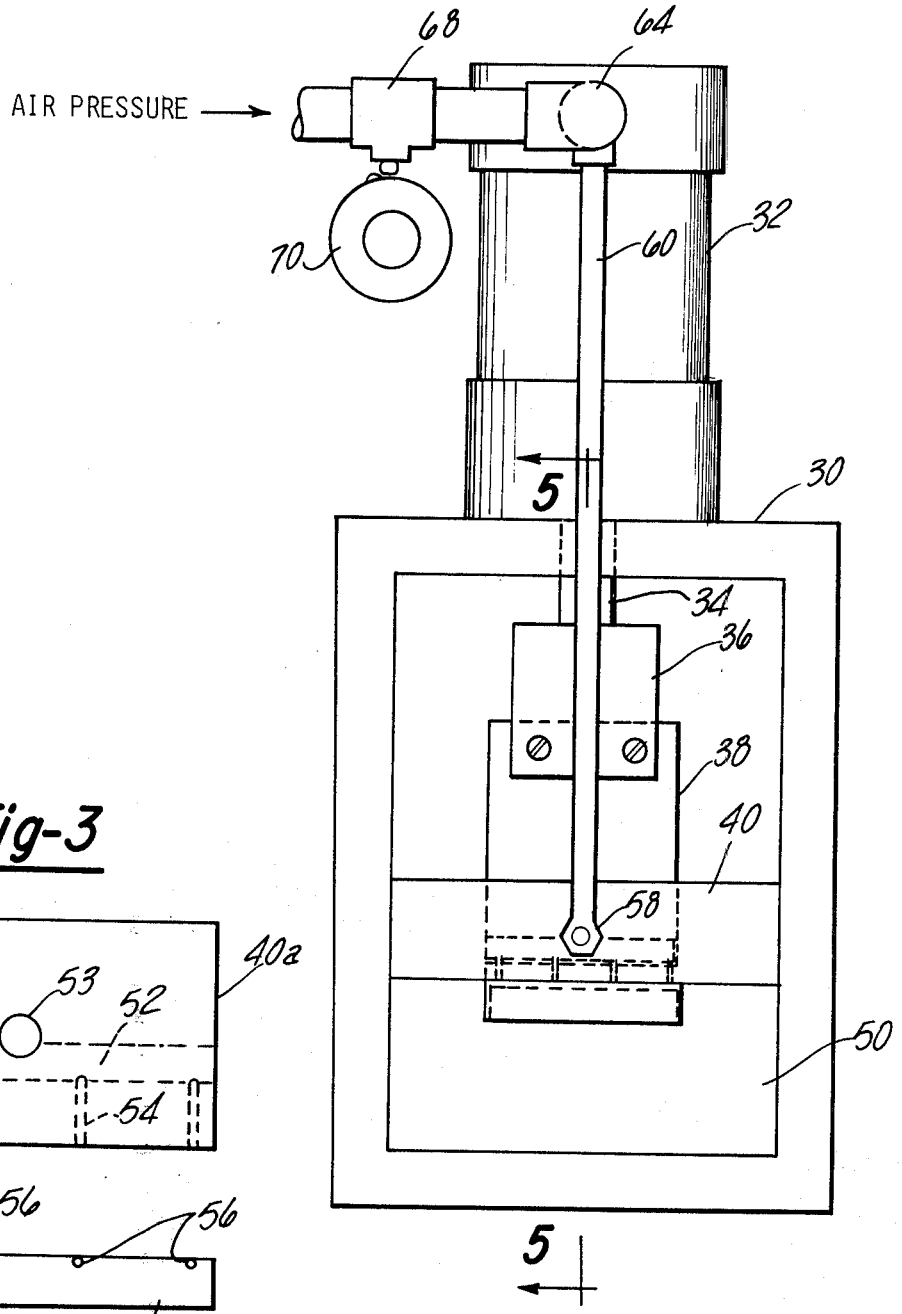
FIG. 2 is an end elevational view of the cut-off mechanism as viewed along the line 2—2 in FIG. 1.
Figure 3:
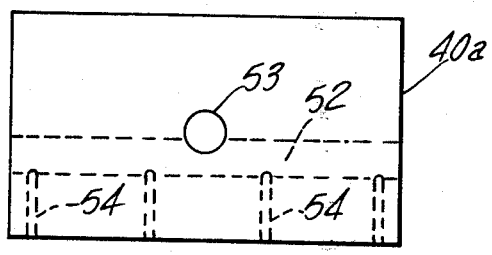
FIG. 3 is a end elevational view of the air manifold of the cut-off mechanism.
Figure 4:
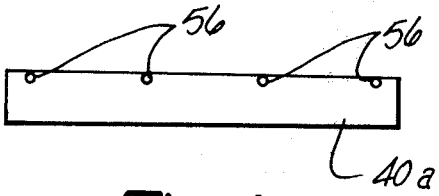
FIG. 4 is a bottom plan view of the air manifold.

As is shown in FIG. 5, the corrugated strip 16 comprises a plurality of successive convolutions which are connected in symmetrical relation by return bends at their upper and lower ends. The return bends at the upper ends of the convolutions can be considered as crests 72 and the return bends at the lower ends of the convolutions can be considered as roots 74. As pointed out previously, in response to rotation of the gathering rolls 22, 24, the corrugated strip 16 is compressed lengthwise into its finished form and advanced to the cut-off mechanism in the manner illustrated in FIG. 5.

Cam 70 is rotated in timed relation with the form rolls 22, 24 so that the upper blade 38 is reciprocated at increments of time corresponding to the desired length of the sections to be sheared from the corrugated strip 16. As soon as valve 68 is opened air under pressure is directed through conduit 60, manifold passageway 52 and then downwardly through the vertical passageways 54. Thus, as soon as blade 38 starts to descend, a curtain of air is directed downwardly against the top side of the corrugated strip being advanced through the cut-off mechanism. As soon as the curtain of air strikes the upper surface of the corrugated strip it tends to deflect apart the two convolutions directly therebelow so that the air stream is directed to the root 74 between the two deflected convolutions. The force of the pressure of this curtain of air is sufficient to momentarily arrest the advancing movement of the corrugated strip 16 through the cut-off mechanism. Since the orifices 56 are positioned directly above the cutting edge 48 of the lower blade 46, the strip is arrested with one of the roots 74 centered directly over and symmetrically aligned with the cutting edge 48 of the lower blade 46. The above-described action occurs alomst instantaneously after valve 68 is opened and before blade 38 engages the corrugated strip. Thus, when the blade 38 descends to the position shown in solid lines in FIG. 5, it shears the corrugated strip directly through one of the roots 74 between the successive convolutions. The direction of the air issuing from orifices 56 downwardly directly toward the cutting edge 48 is also assisted by downwardly moving flat face 44 of blade 38. Since the corrugated strip is being advanced at a relatively uniform rate through the cut-off mechanism, it follows that cam 70 can be timed to arrest movement of the strip and simultaneously actuate blade 38 so that the successive sections cut from the strip will have the required number of convolutions per unit length specified by the manufacturer.

Figure 7:
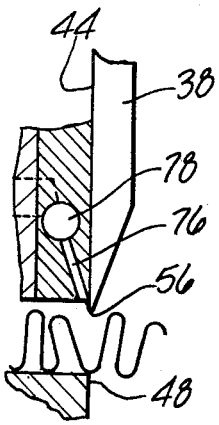
FIGS. 6 and 7 are fragmentary sectional views of a slightly modified form of cut-off mechanism according to the present invention.
Figure 6:
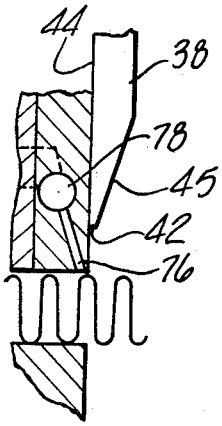

The arrangement shown in FIGS. 6 and 7 differs only slightly from that illustrated in FIG. 5. In FIGS. 6 and 7 the air discharge passageways 76 are inclined downwardly and forwardly from the manifold passageway 78. However, passageways 76 are oriented so that the air discharged therefrom is directed toward the cutting edge 80. As in the previous embodiment described the air direction is assisted by the downwardly moving flat face 44 of blade 38. Thus the return bend between a pair of adjacent convolutions is centered directly over cutting edge 48.

I claim:

1. In combination, means for advancing a corrugated metal strip in a predetermined path, said strip having a series of longitudinally successive convolutions therein which extend transversely of the strip, the successive convolutions being connected at their upper and lower ends by return bends which form successive crests and roots between the successive convolutions, a shear in said path for cutting the strip transversely of its length, said shear having a stationary blade and a movable blade, each provided with a cutting edge and located one above the other below the path of travel of the strip, said stationary blade being positioned to engage the successive crests as the strip is advanced past the shear, means for reciprocating the movable blade toward and away from the stationary blade to shear the strip therebetween in a direction transversely thereof, and means for intermittently directing a stream of air generally perpendicular to the plane of said strip at the location of said stationary blade to urge the strip against the stationary blade, to displace the root between a pair of adjacent convolutions into alignment with the cutting edge of the stationary blade and momentarily arrest the advancing movement of the strip so that, when the movable blade is reciprocated, the strip will be severed transversely along said root.

2. The combination set forth in claim 1 wherein said air directing means are located on the same side of the strip as the movable blade.

3. The combination set forth in claim 1 wherein the movable blade is located above the strip and reciprocates vertically.

4. The combination set forth in claim 3 wherein the cutting edge of the movable blade is located at the lower end of a flat, vertically extending face on the blade, said air directing means being arranged to direct said stream of air downwardly and against said flat face of the movable blade when it is moving toward said stationary blade.

5. The combination set forth in claim 1 wherein said air directing means are intermittently operated in synchronism with the reciprocation of the movable blade.

6. The combination set forth in claim 5 wherein said air directing means are operated when the movable blade is moving toward the stationary blade.

7. The combination set forth in claim 6 including means for advancing the strip at a relatively constant rate.

8. The combination set forth in claim 7 including means for operating said air directing means in timed relation with the rate of advance of said strip so that the successive sections cut from the strip are of generally uniform length and contain generally the same number of convolutions.

9. The combination set forth in claim 3 wherein said air directing means includes a plurality of air passageways extending downwardly adjacent the path of travel of the cutting edge of the movable blade.

10. The combination set forth in claim 1 wherein said means for reciprocating the movable blade comprises an air cylinder, a source of air under pressure connected with said cylinder, valve means interposed between said air source and said cylinder which, when opened, are arranged to direct air under pressure to said cylinder and thereby cause the movable blade to approach the stationary blade, said air directing means including a conduit connected with said valve on the downstream side thereof whereby said air directing means are operated whenever said valve is opened to admit air to said cylinder.

11. The combination set forth in claim 1 wherein said shear includes a guide block on which the movable blade reciprocates, said air directing means comprising an air passageway in said guide block having a discharge opening adjacent said blade.

12. The combination set forth in claim 11 wherein said air passagewway includes an air manifold in said block connected with the source of air under pressure and said discharge opening comprises a a plurality of said discharge orifices communicating with said manifold and space apart transversely of the path of travel of the corrugated strip.

* * * * *